United States Patent [19]

Ito et al.

[11] Patent Number: 4,752,437

[45] Date of Patent: Jun. 21, 1988

[54] PACKAGING OF RADIOACTIVE MATERIALS

[75] Inventors: Masuzo Ito, Hyogo; Haruo Kakunai, Akashi; Tadao Tamamura, Hyogo, all of Japan

[73] Assignee: Kabushiki Kaisha Kobe Seiko Sho, Kobe, Japan

[21] Appl. No.: 805,252

[22] Filed: Dec. 4, 1985

Related U.S. Application Data

[63] Continuation of Ser. No. 570,290, Jan. 13, 1984, abandoned.

[30] Foreign Application Priority Data

| | | | |
|---|---|---|---|
| Jan. 18, 1983 | [JP] | Japan | 58-6902 |
| Jan. 18, 1983 | [JP] | Japan | 58-6901 |
| Mar. 7, 1983 | [JP] | Japan | 58-37595 |

[51] Int. Cl.[4] ..... G21C 19/00

[52] U.S. Cl. ..... 376/272; 250/506.1; 250/507.1

[58] Field of Search ..... 250/506.1, 507.1; 376/272

[56] References Cited

U.S. PATENT DOCUMENTS

| | | | |
|---|---|---|---|
| 2,514,909 | 7/1950 | Strickland | 376/272 |
| 3,111,586 | 11/1963 | Rogers | 376/272 |
| 3,432,666 | 3/1969 | Nash et al. | 250/506.1 |
| 3,731,102 | 5/1973 | Peterson | 250/506.1 |
| 3,770,964 | 11/1973 | Backus | 250/506.1 |
| 3,780,306 | 12/1973 | Anderson et al. | 376/272 |
| 4,030,974 | 6/1977 | Neef | 376/381 |
| 4,272,683 | 6/1981 | Baatz et al. | 376/272 |
| 4,292,528 | 9/1981 | Shaffer et al. | 250/506.1 |
| 4,326,918 | 4/1982 | Lapides | 376/272 |
| 4,339,411 | 7/1982 | Knackstedt et al. | 376/272 |
| 4,399,366 | 8/1983 | Bucholz | 376/272 |
| 4,453,081 | 6/1984 | Christ et al. | 250/506.1 |

FOREIGN PATENT DOCUMENTS

| | | |
|---|---|---|
| 59419 | 9/1982 | European Pat. Off. . |
| 2074726 | 10/1971 | France . |
| 2432198 | 2/1980 | France . |
| 2003782 | 3/1979 | United Kingdom . |
| 2024694 | 1/1980 | United Kingdom . |
| 2038227 | 7/1980 | United Kingdom . |

OTHER PUBLICATIONS

Nuclear News, Feb., 1986, p. 65.

Keese, "The TN 1300 Shipping/Storage Cask System for Spent Fuel", Nuclear Europe, 2/1983, pp. 17, 18.

Dierkes, P. et al., "Transport Casks Help Solve Spent Fuel Interim Storage Problems", *Nuclear Engineering International*, Oct. 1980.

*Primary Examiner*—Stephen C. Bentley
*Assistant Examiner*—Richard W. Wendtland
*Attorney, Agent, or Firm*—Oblon, Fisher, Spivak, McClelland & Maier

[57] ABSTRACT

A packaging for radioactive materials, including a packaging body made of cast iron or cast steel, and a shielding material which is cast within the packaging body in the casting of the packaging body thereby installing firmly the shielding material within the packaging body and attaining an excellent X-ray and neutron shielding from radioactive materials therein.

3 Claims, 3 Drawing Sheets

PACKAGING OF RADIOACTIVE MATERIALS

This application is a continuation of application Ser. No. 570,290, filed Jan. 13, 1984, now abandoned.

BACKGROUND OF THE INVENTION

1. Field of the Invention

The present invention relates to a packaging for radioactive materials. More particularly, it relates to a packaging in which a shielding material is buried and a method of manufacturing such packaging.

2. Description of the Prior Art

A conventional packaging for radioactive materials has a resin layer on the surface of its shell made of forged steel in order to prevent neutrons from streaming out of the packaging. The packaging also has a plurality of fins projecting to the outside through the resin layer in order to dissipate heat from the radioactive materials therein. Since portions of the surface of the shell on which the fins pass through the resin layer lack the resin layer, some neutrons inevitably stream to the outside. Another conventional packaging is provided with hollows in its shell made of cast steel or forged steel and these hollows are filled with resins to shield neutrons. Such hollows are formed by extraordinary deep hole machining which is both troublesome and labor consuming.

On the other hand, as a neutron shielding material, boron nitride or boron carbide has been used. As a neutron moderator accelerating the neutron absorbence of the shielding material, hydrogen-rich materials such as water, paraffin, wood, resin, or concrete have been known. However, when these materials are used as a shielding material for exothermic radioactive materials, they can only be positioned at a certain location because of the lack of heat-resistance and thermal conductivity.

Materials having a boron exhibit a shielding effect against the thermal neutron characteristic zone alone. Materials containing hydrogen as a neutron moderator are required for a dry-type transportation packaging or a dry-type storage packaging for nuclear fuels containing fast neutron, and thus, has to be excellent in terms of both heat-resistance and thermal conductivity characteristics. Materials such as synthetic resins are generally used. Since the resins lack both heat-resistance and thermal conductivity, they should be used together with aluminum and/or carbon to supplement these defects.

SUMMARY OF THE INVENTION

The packaging for radioactive materials of this invention which overcomes the above-discussed disadvantages of the prior arts, comprises a packaging body made of cast iron or cast steel, and a shielding material which is cast within said packaging body in the casting of said packaging body. The shielding material is at least one selected from the group consisting of heavy metals, concrete, organic materials, ceramics, boron nitride, boron carbide, graphite and hydrogenous alloys. The shielding material may be interjected inside the case which is cast in said packaging body in the casting of the packaging body. The case is made of heat-resistant materials such as steel pipes, steel plates or ceramics. The shielding material is continuously disposed in the circumferential direction within said packaging body. As the method for manufacturing the packaging for radioactive materials, a shielding material is positioned in a mold for the packaging body, and cast iron or cast steel is poured in the mold thereby forming the packaging in which said shielding material is cast. The shielding material may be charged inside a case made of heat-resistant materials and then said case is positioned in the mold.

Thus, the invention described herein makes possible the objects of (1) providing a packaging which can attain an effective shielding of $\gamma$-rays and neutrons from streaming therefrom; (2) providing a packaging wherein a shielding material is easily and firmly installed; (3) providing a packaging which can be manufactured with ease; and (4) providing the method for manufacturing the packaging.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
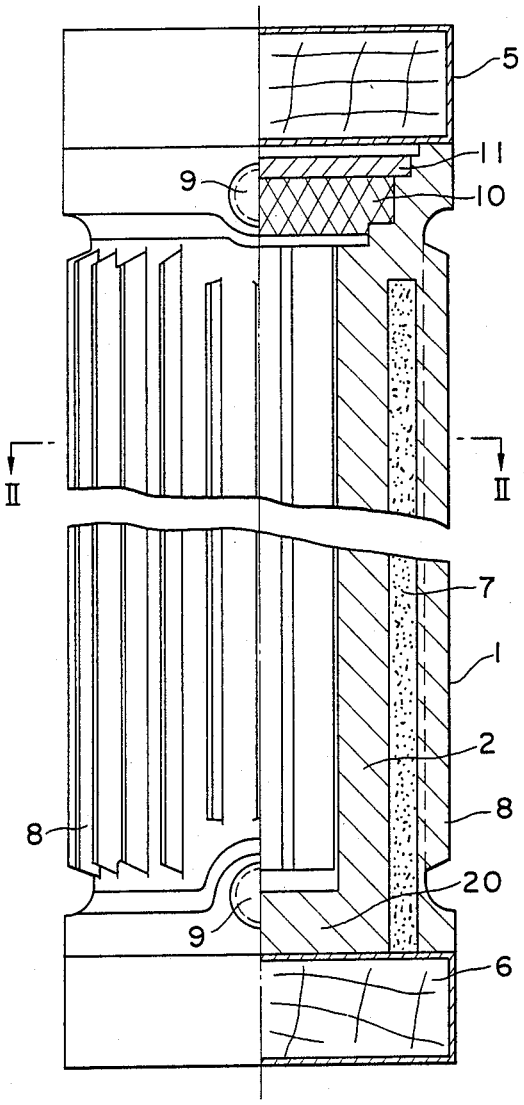
FIG. 1 is a partly sectional side view of a packaging according to this invention.
Figure 2:
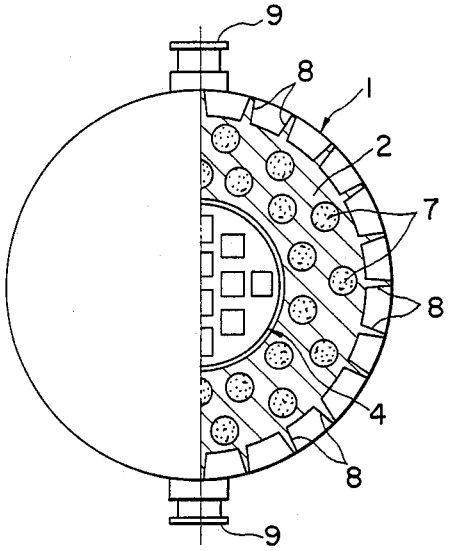
FIG. 2 is a partly transverse sectional view taken along line II—II in FIG. 1.

FIGS. 1 and 2 show a packaging for radioactive materials according to this invention, which comprises a packaging body 1 made of cast iron or cast steel wherein a bottom 20 is united with a shell 2. The open end of the shell 2 is hermetically sealed with the inner lid 10 and the outer lid 11 via a gasket (not shown). At both opposite ends on the surface of the shell 2, trunnions 9 are disposed. Reference numerals 5 and 6 indicate a shock absorbing cover. The packaging body 1 contains a basket 4 for charging of radioactive materials therein to.

Within the shell 2, a plural bar-shaped shielding materials 7 are axially positioned in the circumferential direction in such a manner that neutrons can be shielded from radiating in a radial direction from the basket 4 through the shell 2 of the packaging body 1. The shielding materials may be also disposed within the bottom 20 of the shell 2. On the outer surface of the shell 2, a plurality of fins 8 are disposed to dissipate heat from the radioactive materials. These fins may be circumferentially disposed on the packaging body 1.

Figure 3:
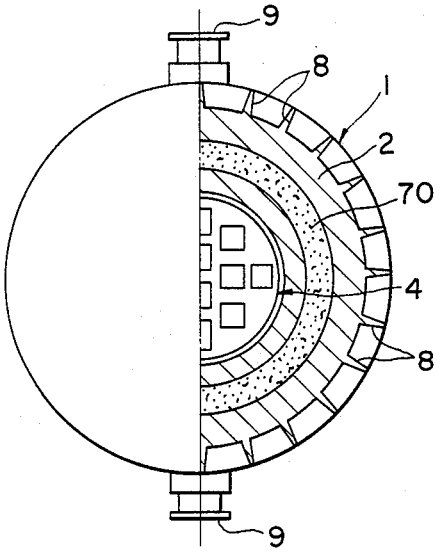
FIG. 3 is a partly transverse sectional view of another packaging according to this invention.

As shown in FIG. 3, an annular arrangement of material 70 can be used as a shielding material instead of the bar-shaped shielding materials. The annular material 70 is circumferentially disposed, so that a more effective shielding effect can be attained thereby enabling the reduction of the thickness of the shell 2.

The shielding materials which can be selected include, for example, ceramic material concrete, heavy metals such as uranium and led, organic materials such as resin, plastics and wood, boron nitride, boron carbide, graphite, hydrogenous alloys or the like.

The packaging according to this invention is manufactured as follows:

A fine powder (diameter: 1–5 μm) of at least one selected from the group consisting of resin, concrete, boron nitride, boron carbide, graphite and hydrogenous alloys is compressed under a high pressure such as for example, about 100 kg/cm$^2$ and; sintered and/or molded in the desired shape. Alternatively, the fine powder may be solidified at about 2000° C. under 200 kg/cm$^2$ by the HIP (Hot Isostatic Pressing) method with the formation of a sintered compact of the desired shape and design. The resulting compact of the shielding material is disposed within a mold (not shown) for a packaging body followed by pouring of cast iron or cast steel into the mold, thereby obtaining packaging body 1 in which the compact of the shielding material is buried within the shell 2. When boron nitride, boron carbide, graphite and hydrogenous alloys are used as the shielding material, the thermal conductivity of such material is so excellent that the cast in the mold can be effectively cooled. Especially, when spheroidal graphite cast iron is used as the shell material, rapid cooling of the cast is required and ideally achieved by using the above-mentioned shielding material, thus resulting in a metal having an excellent structure. Moreover, due to excellent thermal conductivity, the resulting packaging body does not require the use of passages for thermal conduct therein. Since the shielding material is cast within the packaging body, it is firmly installed in the packaging body and the packaging is simple in shape and design. Also, the operation for making hollows in the packaging body and charging the shielding material therein can be omitted thereby simplifying the process of manufacturing the packaging.

Figure 4:
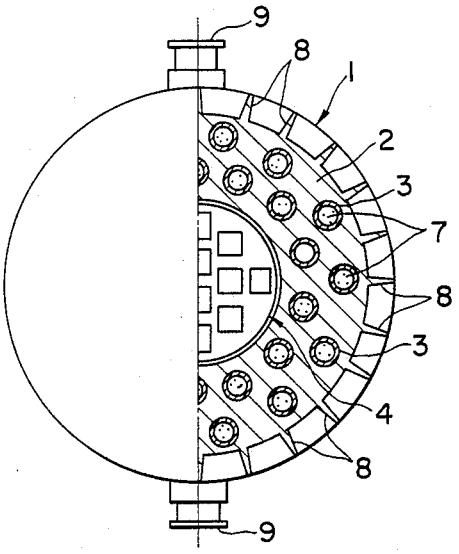
FIG. 4 is a partly transverse sectional view of yet another packaging according to this invention.

Alternatively, as shown in FIG. 4, a plurality of heat-resistant pipes 3 filled with the shielding material 7 may be axially cast within the shell 2. In the event that organic materials are used as the shielding material, cast iron or cast steel is first cast in a mold for the packaging body, to bury the pipes 3 within the packaging body and then the organic materials are charged into said pipes 3 under pressure. In the event that boron nitride, boron carbide or graphite is used as the shielding material, it is first charged into the pipes 3 and then the pipes 3 are disposed in the mold for the packaging body followed by pouring cast iron or cast steel into the mold. These shielding materials may be charged into the pipes 3 in a fine powder form or a sintered compact form.

Figure 5:
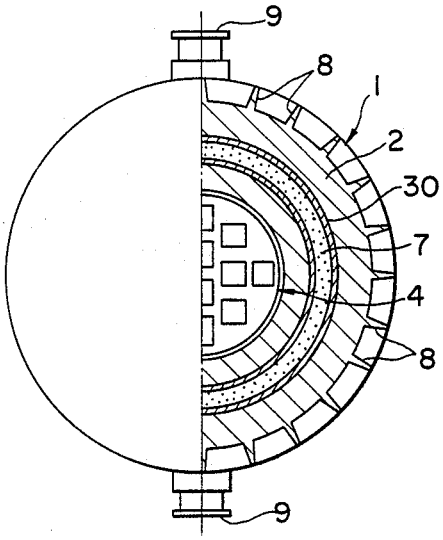
FIG. 5 is a partly transverse sectional view of an additional packaging according to this invention.
Figure 6:
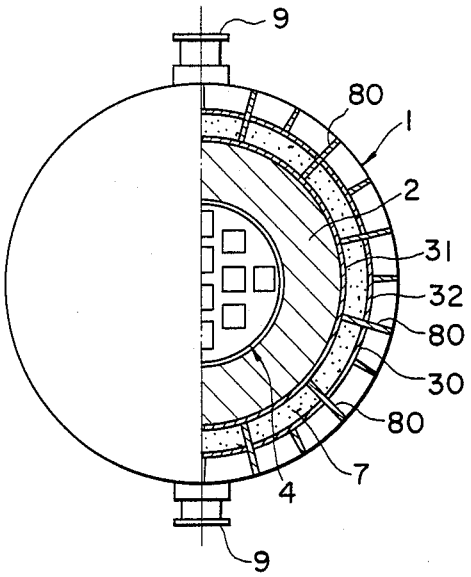
FIG. 6 is a partly transverse sectional view of another packaging according to this invention.

Instead of utilizing the pipes 3 an annular case 30 may be employed, as shown in FIG. 5, which is circumferentially positioned to thereby attain a better shielding effect and reduce the thickness of the shell 2 as well. As shown in FIG. 6, the fins 80 may be formed in such a manner that the inner plate 31 and the outer plate 32 constituting the case 30 are connected with each other by the fins 80. The fins 80 may be connected to the inner plate 31 and the outer plate 32 by means of welding, thereby preventing the inner plate 31 from shifting from the cast compact, i.e. shell 2.

Figure 9:
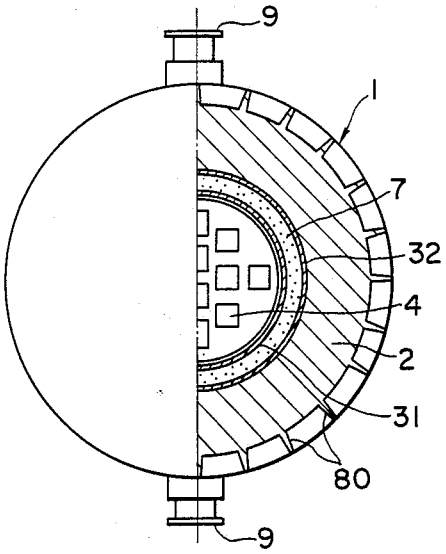
FIG. 9 is a partly transverse sectional view of another packaging of this invention.
Figure 7:
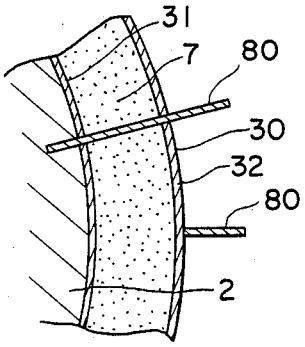
FIGS. 7 and 8 are partly enlarged sectional views of a further packaging of this invention, respectively.
Figure 8:
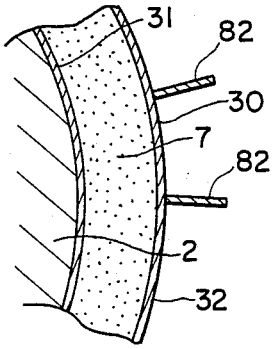

FIG. 7 shows another fin 80 which is formed such that it passes through the shielding material 7 and its end is positioned toward the inside of the inner plate 31, thereby tightly connecting the case 30 to the cast compact. FIG. 8 shows another fin 82 which is formed on the outside of the outer plate 32 and thus the shielding material 7 is circumferentially oriented to thereby attain a complete shielding effect. FIG. 9 shows an annular shielding case, consisting of inner plate 31 and outer plate 32, which is located inside the inner wall of the shell 2. As seen from the above-mentioned various embodiments, the pipes or the case in which the shielding material is to be injected may be positioned at any location within the packaging body. Since the case for the shielding material is cast within the packaging body, it is firmly mounted to the packaging body and the packaging is simple in shape and design. Moreover, the operation of charging the shielding material into the pipes or the case can be performed in parallel with the formation of the mold for the packaging body.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. In a radioactive material packaging, a packaging comprising a packaging body having a substantially U-shaped longitudinal cross-section formed by a bottom and a shell, said bottom and said shell defining a hollow chamber for receiving radioactive material, wherein said bottom and said shell comprise:

case means disposed substantially lengthwise of said shell;

a shielding material disposed within said case means, and a body of metal cast about said case means, said body of metal being substantially free of discontinuities other than discontinuities where said body of metal contacts said case means.

2. A packaging according to claim 1, wherein said shielding material is selected from the group consisting of ceramics, concrete, heavy metals, organic material, boron nitride, boron carbide, graphite and hydrogenous alloys.

3. A packaging according to any of claims 1 or 2, wherein said case means further comprises a heat-resistant material selected from the group consisting of steel pipes, steel plates or ceramics.

* * * * *